US009289643B2

(12) United States Patent
Demarco et al.

(10) Patent No.: US 9,289,643 B2
(45) **Date of Patent: *Mar. 22, 2016**

(54) APPARATUSES, SYSTEMS, AND METHODS FOR IMPROVEMENT OF PHYSICAL FITNESS

(71) Applicant: 12NOVEM INDUSTRIES, INC., Austin, TX (US)

(72) Inventors: Brian Demarco, Driftwood, TX (US); Autumn Demarco, Driftwood, TX (US)

(73) Assignee: 12NOVEM INDUSTRIES, INC., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/531,657

(22) Filed: Nov. 3, 2014

(65) Prior Publication Data

US 2015/0151155 A1 Jun. 4, 2015

Related U.S. Application Data

(63) Continuation of application No. 13/368,916, filed on Feb. 8, 2012, now Pat. No. 8,876,679.

(60) Provisional application No. 61/440,673, filed on Feb. 8, 2011.

(51) Int. Cl.
*A63B 21/055* (2006.01)
*A63B 1/00* (2006.01)
(Continued)

(52) U.S. Cl.
CPC ..... *A63B 21/0552* (2013.01); *A63B 1/00* (2013.01); *A63B 7/02* (2013.01);
(Continued)

(58) Field of Classification Search
CPC ..... A63B 7/00–7/085; A63B 21/00047; A63B 21/00181; A63B 21/00185; A63B 21/002–21/0023; A63B 21/02; A63B 21/04–21/0407; A63B 21/0442; A63B 21/0552–21/0557; A63B 21/068; A63B 21/1627–21/1663
USPC ..... 482/23–24, 37, 40, 43, 91–96, 482/121–126, 129–131, 139, 142–143, 904, 482/907
See application file for complete search history.

(56) References Cited

U.S. PATENT DOCUMENTS

| | | | | |
|---|---|---|---|---|
| 4,909,505 | A | 3/1990 | Tee | 482/129 |
| 5,125,649 | A | 6/1992 | Fuller | 482/123 |

(Continued)

FOREIGN PATENT DOCUMENTS

| | | |
|---|---|---|
| CN | 101801470 | 8/2010 |
| JP | 2003275341 | 9/2003 |

(Continued)

*Primary Examiner* — Loan H Thanh
*Assistant Examiner* — Jennifer M Deichl
(74) *Attorney, Agent, or Firm* — Norton Rose Fulbright US LLP

(57) ABSTRACT

The present application includes various embodiments of apparatuses, systems, kits, and methods for physical exercise of a user. Some embodiments, for example, include an apparatus comprising: a strap having a first end, a second end, a length between the first end and the second end, the strap having an elastic portion between and spaced apart from the first end and the second end; a first handle configured to be coupled to the strap on a first side of the elastic portion such that the first handle is spaced apart from the elastic portion; a second handle configured to be coupled to the strap on a second side of the elastic portion such that the second handle is spaced apart from the elastic portion; and one or more suspension members configured to be coupled (i) to the strap at a first point between the elastic portion and the first handle, and at a second point between the elastic portion and the second handle, and (ii) to be coupled to a supporting structure.

21 Claims, 12 Drawing Sheets

(51) Int. Cl.
*A63B 7/02* (2006.01)
*A63B 23/12* (2006.01)
*A63B 21/00* (2006.01)

(52) U.S. Cl.
CPC .... *A63B 21/00043* (2013.01); *A63B 21/00181* (2013.01); *A63B 23/1218* (2013.01); *A63B 23/1236* (2013.01); *A63B 21/1469* (2013.01); *A63B 21/4035* (2015.10); *A63B 2209/023* (2013.01)

(56) References Cited

U.S. PATENT DOCUMENTS

| | | | | |
|---|---|---|---|---|
| 5,403,253 | A | 4/1995 | Gaylord | 482/43 |
| 5,558,609 | A | 9/1996 | Olschansky et al. | 482/122 |
| 5,662,555 | A * | 9/1997 | Cloutier | A63B 7/00 482/143 |
| 5,688,210 | A | 11/1997 | Chou | 482/56 |
| 5,871,424 | A | 2/1999 | Conner | 482/129 |
| 5,910,073 | A | 6/1999 | Conner | 482/129 |
| 5,941,802 | A | 8/1999 | Kiser | 482/92 |
| 6,238,324 | B1 | 5/2001 | MacMillan | 482/121 |
| 6,368,256 | B1 | 4/2002 | Rumbaugh | 482/121 |
| 6,450,929 | B1 | 9/2002 | Markham | 482/121 |
| 6,450,930 | B1 | 9/2002 | Kroke | 482/121 |
| 6,494,818 | B1 | 12/2002 | Richmond | 482/121 |
| 6,726,606 | B2 | 4/2004 | Jacobsen | 482/121 |
| 6,746,383 | B2 | 6/2004 | Yu | 482/127 |
| 6,908,418 | B2 | 6/2005 | Saure | 482/121 |
| 6,921,354 | B1 | 7/2005 | Shifferaw | 482/91 |
| 7,044,896 | B2 | 5/2006 | Hetrick | 482/95 |
| 7,104,935 | B2 | 9/2006 | Matsuoka | 482/124 |
| 7,137,935 | B2 | 11/2006 | Clarke et al. | 482/123 |
| 7,217,227 | B2 | 5/2007 | Finn | 482/92 |
| 7,255,666 | B2 | 8/2007 | Cardenas | 482/143 |
| 7,621,847 | B2 | 11/2009 | Lamle et al. | 482/40 |
| 7,727,131 | B2 | 6/2010 | Longo | 482/124 |
| 7,740,570 | B2 | 6/2010 | Winston | 482/121 |
| 7,762,932 | B2 | 7/2010 | Hetrick | 482/91 |
| 7,785,242 | B2 | 8/2010 | Solomon | 482/121 |
| 7,922,634 | B1 | 4/2011 | Wu | 482/126 |
| 7,955,236 | B2 | 6/2011 | Digiovanni et al. | 482/124 |
| 7,976,445 | B2 | 7/2011 | Lalaoua | 482/129 |
| 8,012,071 | B2 | 9/2011 | Grisdale | 482/122 |
| 8,033,966 | B2 | 10/2011 | Ayoub | 482/121 |
| 8,152,703 | B1 | 4/2012 | Hinds et al. | 482/122 |
| 8,157,712 | B1 | 4/2012 | Musachio | 482/121 |
| 2001/0034291 | A1 * | 10/2001 | Horton | A63B 21/0552 482/124 |
| 2002/0137609 | A1 | 9/2002 | Rosati | 482/126 |
| 2002/0187884 | A1 | 12/2002 | McGrath | 482/121 |
| 2003/0158024 | A1 | 8/2003 | Saure | 482/126 |
| 2003/0216220 | A1 | 11/2003 | Rota | 482/27 |
| 2004/0087420 | A1 | 5/2004 | Montesquieux | 482/129 |
| 2004/0116259 | A1 | 6/2004 | Rosiles | 482/121 |
| 2004/0127339 | A1 | 7/2004 | Finn | 482/92 |
| 2005/0107226 | A1 | 5/2005 | Monda | 482/121 |
| 2005/0113223 | A1 | 5/2005 | Dovner et al. | 482/121 |
| 2005/0170937 | A1 | 8/2005 | van Straaten | 482/124 |
| 2006/0019806 | A1 | 1/2006 | Mikulski | 482/121 |
| 2007/0060454 | A1 | 3/2007 | Vogel | 482/121 |
| 2007/0117694 | A1 | 5/2007 | Fitzmaurice | 482/124 |
| 2007/0173383 | A1 | 7/2007 | Feigenbaum et al. | 482/91 |
| 2007/0232449 | A1 | 10/2007 | Planke | 482/1 |
| 2007/0287614 | A1 | 12/2007 | Fuller | 482/121 |
| 2007/0287616 | A1 | 12/2007 | Weaver | 482/124 |
| 2008/0141506 | A1 | 6/2008 | Langtry et al. | 24/615 |
| 2008/0293545 | A1 | 11/2008 | Planke | 482/7 |
| 2009/0075789 | A1 | 3/2009 | Hetrick | 482/91 |
| 2009/0075790 | A1 | 3/2009 | Hetrick | 482/92 |
| 2009/0215593 | A1 | 8/2009 | Ligrano et al. | 482/124 |
| 2010/0126902 | A1 | 5/2010 | Garza et al. | 206/579 |
| 2010/0152002 | A1 | 6/2010 | Knight | 482/93 |
| 2011/0172064 | A1 | 7/2011 | Cutler et al. | 482/63 |
| 2011/0224055 | A1 | 9/2011 | Kassel | 482/121 |
| 2011/0237410 | A1 | 9/2011 | Perez | 482/129 |
| 2012/0108403 | A1 | 5/2012 | Zandman-Zeman | 482/121 |

FOREIGN PATENT DOCUMENTS

| | | |
|---|---|---|
| WO | WO 2005/051495 | 6/2005 |
| WO | WO 2007/106754 | 9/2007 |

* cited by examiner

APPARATUSES, SYSTEMS, AND METHODS FOR IMPROVEMENT OF PHYSICAL FITNESS

CROSS-REFERENCE TO RELATED APPLICATIONS

This application is a continuation of U.S. patent application Ser. No. 13/368,916, filed Feb. 8, 2012, which claims priority to U.S. Provisional Patent Application No. 61/440,673, filed Feb. 8, 2011, both of which are incorporated herein by reference in their entireties.

BACKGROUND

1. Field of the Invention

The present invention relates generally to improvement of physical fitness and, more particularly, but not by way of limitation, to an apparatus that can be used to perform a variety of exercises with a variety of levels of assistance and/or resistance.

2. Description of Related Art

Examples of exercise apparatuses are disclosed in U.S. Pat. No. 7,217,227; U.S. Pat. No. 7,651,448; U.S. Pat. No. 8,012,071; and U.S. Pat. No. 8,033,966.

SUMMARY

This disclosure includes embodiments of apparatuses, systems, kits, and methods. Some embodiments can, for example, be useful for recreational exercise, rehabilitative exercise (e.g., after injury, surgery, joint replacement, etc.).

Some embodiments of the present apparatuses comprise: a strap having a first end, a second end, a length between the first end and the second end, the strap having an elastic portion between and spaced apart from the first end and the second end; a first handle configured to be coupled to the strap on a first side of the elastic portion such that the first handle is spaced apart from the elastic portion; a second handle configured to be coupled to the strap on a second side of the elastic portion such that the second handle is spaced apart from the elastic portion; and one or more suspension members configured to be coupled (i) to the strap at a first point between the elastic portion and the first handle, and at a second point between the elastic portion and the second handle, and (ii) to be coupled to a supporting structure.

In some embodiments of the present apparatuses, the strap includes a strap assembly comprising: an elastic segment that includes at least a part of the elastic portion of the strap; a first substantially-inelastic segment configured to be coupled to the elastic segment and to extend to the first end of the strap; and a second substantially-inelastic segment configured to be coupled to the elastic segment and to extend to the second end of the strap. In some embodiments, the elastic segment comprises at least one of: natural rubber, synthetic rubber, or a combination thereof. In some embodiments, the elastic segment comprises a plurality of strands of material. In some embodiments, the first substantially inelastic segment and second substantially inelastic segment are each configured to be removably coupled to the elastic segment. Some embodiments further comprise: a first connector configured to couple the first substantially-inelastic segment to the elastic segment; and a second connector configured to couple the second substantially-inelastic segment to the elastic segment.

Some embodiments of the present apparatuses further comprise: a first adjuster coupled to the one or more suspension members, and coupled to the strap between the first end of the strap and the elastic portion; a second adjuster coupled to the one or more suspension members, and coupled to the strap between the second end of the strap and the elastic portion. In some embodiments, the first and second adjusters are each configured such that (i) if the adjuster is in a first configuration, the adjuster will slide relative to the strap; and (ii) if the adjuster is in a second configuration, the adjuster will resist sliding relative to the strap. In some embodiments, the first and second adjusters are configured to remain in the second configuration if there is tension in a portion of the strap between the adjuster and the elastic portion. Some embodiments further comprise: a first locking member coupled to the one or more suspension members and coupled to the strap to resist sliding of the first adjuster relative to the strap in the absence of tension in the portion of the strap between the first adjuster and the elastic portion; and a second locking member coupled to the one or more suspension members and coupled to the strap to resist sliding of the second adjuster relative to the strap in the absence of tension in the portion of the strap between the second adjuster and the elastic portion. In some embodiments, the first and second adjusters each comprises: a body having an opening disposed in a first plane, and a pair of spaced-apart slots each disposed in a second plane that is not parallel to the first plane; and a rod configured to extend between and into each of the spaced-apart slots such that the rod is slidable relative to the body; where the strap extends through the opening twice and around the rod. In some embodiments, the one or more suspension members comprise: a first suspension member having a first end and a second end, the first end configured to be coupled to first adjuster, and the second end configured to be coupled to a supporting structure; and a second suspension member having a first end and a second end, the first end configured to be coupled to the second adjuster, and the second end configured to be coupled to a supporting structure. Some embodiments further comprise: a first connector coupled to second end of the first suspension member and configured to couple the first suspension member to a supporting structure; and a second connector coupled to second end of the second suspension member and configured to couple the second suspension member to a supporting structure.

In some embodiments of the present apparatuses, the first and second suspension members are each flexible. In some embodiments, the first handle and the second handle each comprises a ring. In some embodiments, the first handle and the second handle each comprises a flexible portion and a substantially rigid portion that cooperates with the flexible portion to define at least one loop. In some embodiments, the first handle and the second handle are each substantially rigid. Some embodiments further comprise: a supporting structure having a bar to which the one or more suspension members can be coupled.

In some embodiments of the present apparatuses, the one or more suspension members are configured to be coupled to a supporting structure and in substantially-fixed relation to the strap, with a part of the strap between the first and second points at which the one or more suspension members is coupled to the strap forming a U-shape onto which the feet of a user can be positioned such that the elastic portion can assist the user in performing pull-ups from the supporting structure.

In some embodiments of the present apparatuses, the one or more suspension members are configured to be coupled to a supporting structure and in substantially-fixed relation to the strap, with a part of the strap between the first and second points at which the one or more suspension members is coupled to the strap forming a U-shape onto which the trunk of a user can be positioned such that the elastic portion can assist the user in performing push-ups from the ground or from the handles. In some embodiments, the apparatus is further configured such that the elastic portion can assist the use in performing push-ups from the ground while the user's feet are positioned in the handles.

Some embodiments of the present kits comprise any embodiment of the present apparatuses that comprises a removable elastic segment (e.g., first and second substantially inelastic segments configured to be removably coupled to the elastic segment), where the elastic segment is a first elastic segment; and comprise an additional or alternate elastic segment. In some embodiments, the additional or alternate elastic segment has a higher modulus of elasticity than the first elastic segment.

Some embodiments of the present methods comprise: coupling the one or more suspension members of any embodiment of the present apparatuses to a supporting structure with a part of the strap between the first and second points at which the one or more suspension members are coupled to the strap forming a U-shape.

Some embodiments of the present methods comprise: positioning at least one foot of a user onto the U-shape and performing pull-ups such that the elastic portion assists the user in performing the pull-ups.

Some embodiments of the present methods comprise: positioning the trunk of a user onto the U-shape and performing push-ups such that the elastic portion assists the user in performing the push-ups. In some embodiments, at least one hand of the user is supported by a surface while performing the push-ups. In some embodiments, at least one hand of the user is supported by at least one of the handles while performing the push-ups.

Some embodiments of the present methods comprise: adjusting the position of the one or more suspension members relative to at least one of the first end of the strap and the second end of the strap.

Some embodiments of the present methods comprise: adjusting, after positioning at least one foot of the user, the position of the one or more suspension members relative to at least one of the first end of the strap and the second end of the strap to increase the length of strap between the first and second points at which the one or more suspension members is coupled to the strap.

Any embodiment of any of the devices, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Details associated with the embodiments described above and others are presented below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The embodiments of the present bait stations and their components shown in the figures are drawn to scale.

DESCRIPTION OF ILLUSTRATIVE EMBODIMENTS

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a bait station that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Further, a device or system that is configured in a certain way is configured in at least that way, but it can also be configured in other ways than those specifically described.

Figure 1:
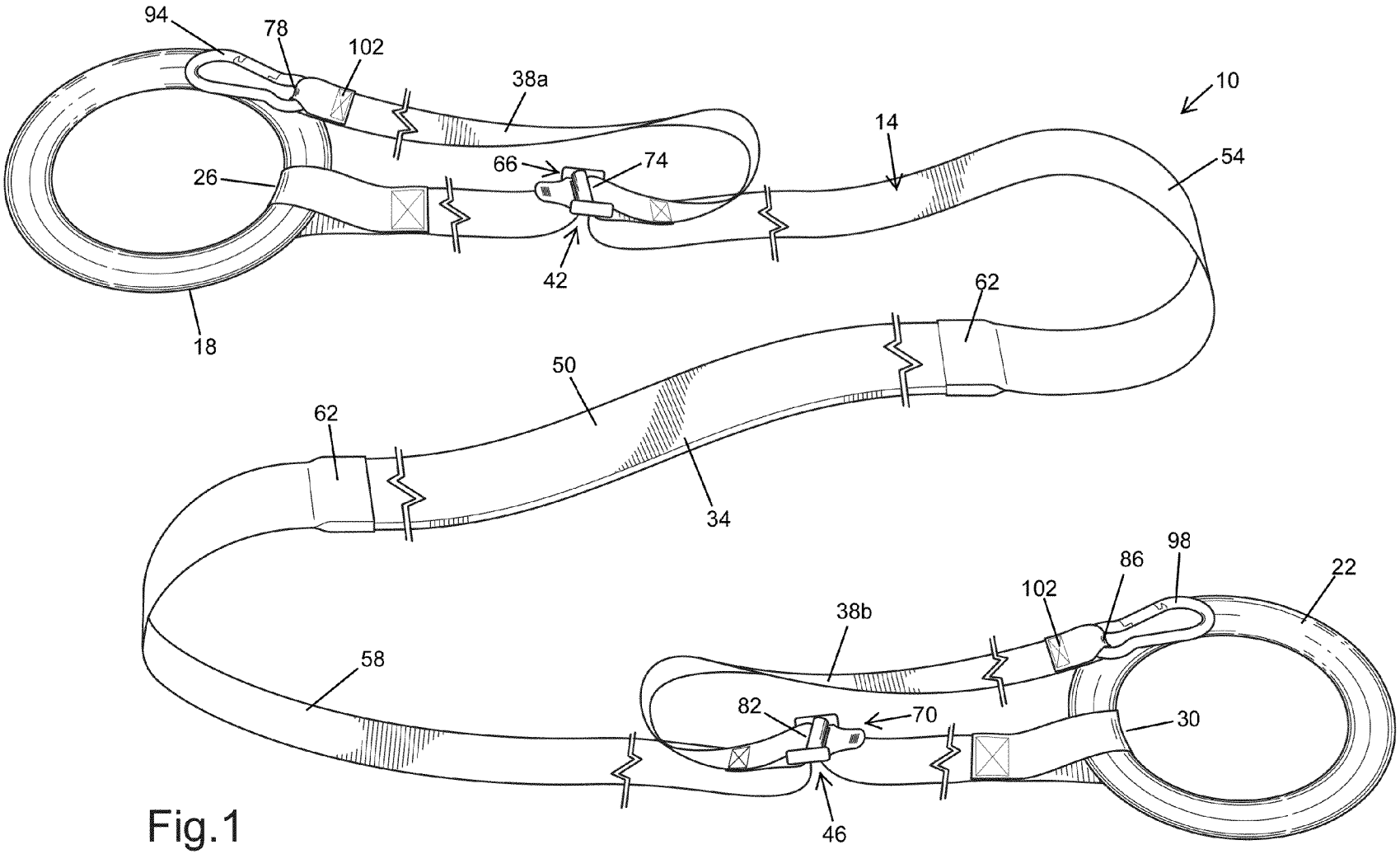
FIGS. 1-2 depict perspective and side views, respectively, of one embodiment of the present apparatuses.
Figure 2:
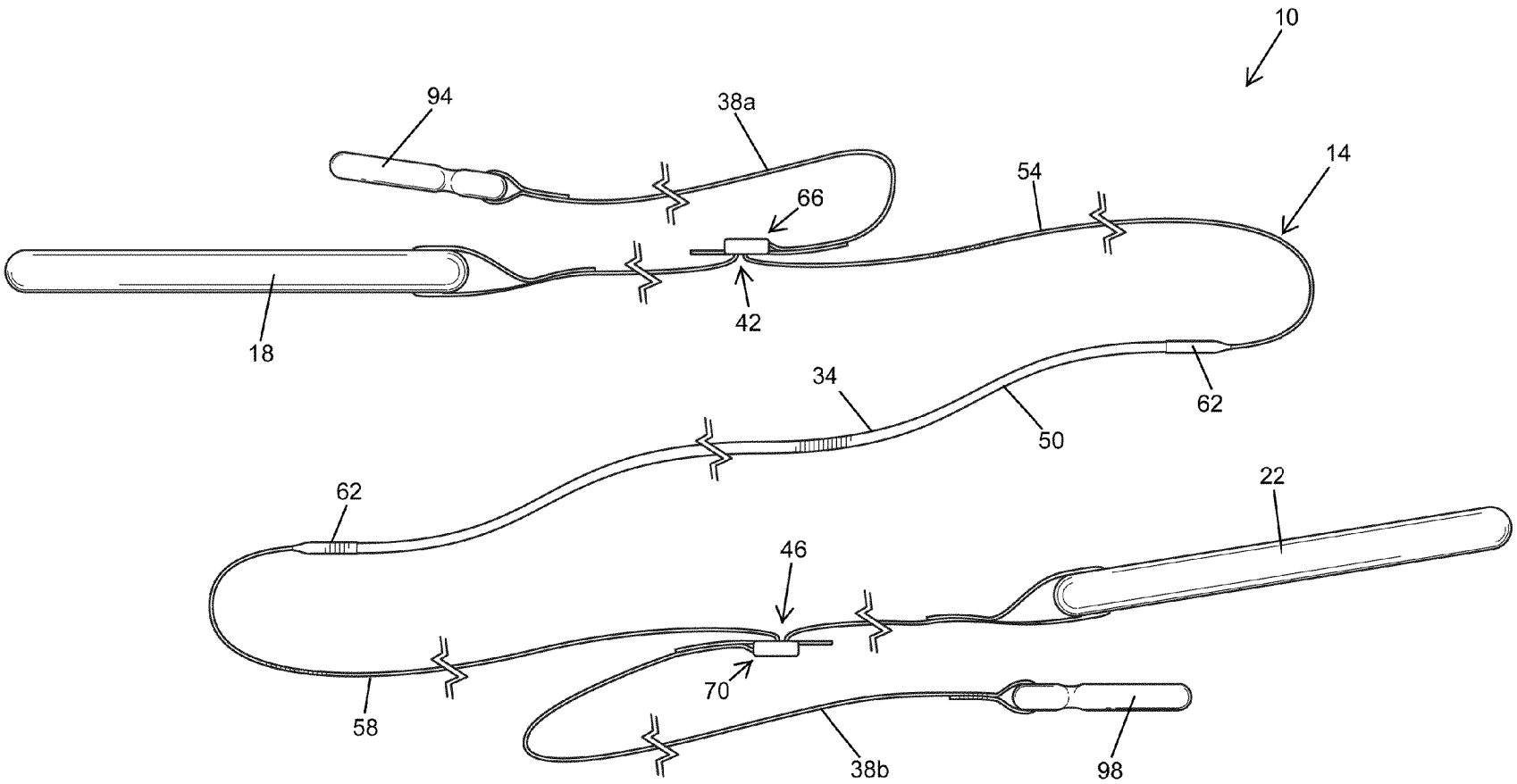

Referring now to the drawings, and more particularly to FIGS. 1-2, shown therein and designated by the reference numeral 10 is one embodiment of the present apparatuses. In the embodiment shown, apparatus 10 is generally portable and usable with different support structures (e.g., in different places), as described below in more detail. In the embodiment shown, apparatus 10 comprises: a strap (e.g., a primary strap) 14, a first handle 18, and a second handle 22. Strap 14 can comprise any suitable material that permits apparatus 10 to function as described in this disclosure. For example, strap 14 can comprise a woven strap-like or webbing material with a flat cross-sectional shape (e.g., polyester, nylon, cotton, and/or the like), and/or having a width of at least, or between any two of: 0.5, 1, 2, 3, 4, or more inches. In the embodiment shown, handles 18 and 22 are each circular (e.g., similar to the circular handles used in gymnastics) that can comprise one or materials such as wood, polymer, and/or the like; and that can be coupled to strap 14 by doubling strap over itself around a portion of the handle and then affixing the strap to itself (e.g., with stitches, adhesive, rivets, and/or the like) to form a loop, as shown. In the embodiment shown, strap 14 has a first end 26, a second end 30, and a length between first end 26 and second end 30. In the embodiment shown, strap 14 also includes an elastic portion 34 between and spaced apart from first end 26 and second end 30.

Elastic portion 34 can, for example, comprise at least one of: natural rubber (e.g., latex), synthetic rubber (e.g., latex), rubberized neoprene, ethylene propylene diene monomer (EPDM) rubber, various natural gums, shock cord or bungee cord, and/or various other elastic materials, or a combination of any two or more of the foregoing; and/or can comprise a plurality of strands of material (e.g., in a woven, or laminated configuration). Elastic portion 34 can also have any suitable modulus of elasticity and/or tensile strength. For example, in some embodiments, elastic portion 34 has a tensile strength of at least 300 lbs, 500 lbs, 750 lbs, 1000 lbs, 1500 lbs, or more. In the embodiment shown, first handle 18 is configured to be coupled to (and is shown coupled to) the strap on a first side of elastic portion 34 (e.g., at first end 26, as shown) such that handle 18 is spaced apart from elastic portion 34. Similarly, in the embodiment shown, second handle 22 is configured to be coupled (and is shown coupled) to the strap on a second side of elastic portion 34 (e.g., at second end 30, as shown) such that handle 22 is spaced apart from elastic portion 34. In other embodiments first end 26 can extend beyond handle 18 (e.g., such that handle 18 is configure to be coupled to strap between first end 26 and elastic portion 34); and/or second end 30 can extend beyond handle 22 (e.g., such that handle 22 is configured to be coupled to strap between second end 30 and elastic portion 34). In the embodiment shown, other than elastic portion 34, strap 14 is substantially inelastic (e.g., may comprise woven strap material, such as, for example, any of the types of strap material used for automotive seatbelts, cargo tie-downs, and the like). In some embodiments, elastic portion 34 has a flat cross-sectional shape; and/or has a width substantially equal to the width of the portions of strap 14 between elastic portion 34 and ends 26 and 30 (e.g., of at least, or between any two of: 0.5, 1, 2, 3, 4, or more inches). For example, in some embodiments, the entire length of strap 14 (including elastic portion 34) has a flat cross-sectional shape with a nominal width of 2 inches (and, in some such embodiments, elastic portion 34 has a thickness of 4.75 millimeters). In some embodiments, elastic portion 34 is covered by a sleeve of material (e.g., cotton fabric), such as, for example, to provide a soft outer surface for contact with a user during use.

In some embodiments, apparatus 10 also comprises one or more suspension members configured to be coupled (i) to the strap at a first point 42 between elastic portion 34 and first handle 18, and at a second point 46 between elastic portion 34 and second handle 22; and (ii) to be coupled to a supporting structure (e.g., bar 204, as shown in FIGS. 3-8). For example, in the embodiment shown, apparatus 10 comprises two suspension members: a first suspension member 38*a* that is configured to be coupled (i) to the strap at the first point 42, and (ii) to be coupled to a supporting structure (e.g., bar 204, as shown in FIGS. 3-8); and a second suspension member 38*b* that is configured to be coupled to the strap at second point 46, and to a supporting structure (e.g., bar 204, as shown in FIGS. 3-8). In other embodiments, a single supporting member can be configured to be coupled to the strap at both points 42 and 46, and to a supporting structure (e.g., at one or more points). Points 42 and 46 can be spaced apart by a distance of, for example: equal to, greater than, or between any of: 6, 12, 18, 24, 30, or more inches. In the embodiment shown, suspension members 38*a* and 38*b* comprise a flexible, substantially-inelastic strap material (e.g., may comprise woven strap material, such as, for example, any of the types of strap material used for automotive seatbelts, cargo tie-downs, and the like) similar to that of strap 14 (e.g., substantially-inelastic members 54 and 58), but having a smaller width (in other embodiments, suspension members can have a width that is less than or greater than that of members 54 and 58). For example, suspension members 38*a* and 38*b* can each comprise a woven strap-like or webbing material with a flat cross-sectional shape (e.g., polyester, nylon, cotton, and/or the like), and/or having a width of at least, or between any two of: 0.5, 1, 2, 3, 4, or more inches. In other embodiments, the one or more suspension members can be substantially rigid.

In the embodiment shown, strap 14 includes a strap assembly comprising: an elastic segment 50 that includes at least a part (e.g., all, as shown) of elastic portion 34; a first substantially-inelastic segment 54 configured to be coupled to elastic segment 50 and extend to first end 26 of the strap; and a second substantially-inelastic segment 58 configured to be coupled to elastic segment 34 and extend to second end 30 of the strap. In some embodiments, such as the one shown, first segment 54 is substantially identical to second segment 58. Elastic segment 50 (e.g., elastic portion 34) can comprise, for example, at least one of: natural rubber (e.g., latex), synthetic rubber (e.g., latex), rubberized neoprene, ethylene propylene diene monomer (EPDM) rubber, various natural gums, shock cord or bungee cord, and/or various other elastic materials, or a combination of any two or more of the foregoing; and/or can comprise a plurality of strands of material (e.g., in a woven, or laminated configuration). In some embodiments, elastic segment 50 (e.g., and elastic portion 34) has a relaxed (unstretched) length equal to, or between any two of: 12 inches, 18 inches, 24 inches, 30 inches, 36 inches, or more. In some embodiments, first and second segments 54 and 58 each has a length equal to, or between any two of: 4 feet, 5 feet, 6 feet, 7 feet, 8 feet, 9 feet, 10 feet, or more.

First and second segments 54 and 58 can be configured to be coupled to elastic segment in any manner that permits the apparatus to function as described in this disclose. In some embodiments, first and/or second segments 54 and 58 are non-removably coupled to elastic segment (e.g., by way of stitches, adhesives, rivets, and/or the like). For example, in the embodiment shown, first segment 54 and second segment 58 are each stitched (and/or crimped, glued, riveted, and/or the like) to elastic segment 50 in connection portions 62 that can overlap (e.g., do overlap in the embodiment shown) at least part of the elastic portion. In other embodiments, first substantially inelastic segment 54 and second substantially inelastic segment 58 are each configured to be removably coupled to elastic segment 50 (e.g., via connectors such as, for example: clips, buckles, clamps, or the like (not shown, but suitable types of buckles and connectors are used for automotive seat-belt buckles, other canvas straps, and the like)). Such embodiments can further comprise: a first connector (not shown, but at or in place of connection portion 62) configured to couple the first substantially-inelastic segment to the elastic segment; and a second connector (not shown, but at or in place of connection portion 62) configured to couple the second substantially-inelastic segment to the elastic segment. Some embodiments of the present kits comprise a plurality of elastic segments (e.g., each with a different modulus of elasticity or strength to provide different levels of assistance or resistance, as described in more detail below).

In some embodiments, apparatus 10 comprises a first adjuster 66 coupled to the one or more suspension members, and coupled to the strap between the first end of the strap and the elastic portion; and apparatus 10 comprises a second adjuster 70 coupled to the one or more suspension members, and coupled to the strap between the second end of the strap and the elastic portion. For example, in the embodiment shown, apparatus 10 comprises a first adjuster 66 coupled to first suspension member 38*a* and coupled to strap 14 between first end 26 and elastic portion 34; and apparatus 10 comprises a second adjuster 70 coupled to second suspension member 38*b* and coupled to strap 14 between second end 30 and elastic portion 34. In the embodiment shown, first suspension member 38*a* is (e.g., non-removably) coupled in fixed relation to adjuster 66, and second suspension member 38*b* is (e.g., non-removably) coupled in fixed relation to adjuster 70. In the embodiment shown, adjusters 66 and 70 are each configured such that (i) if the adjuster is in a first configuration, the adjuster will slide relative to strap 14 (e.g., to adjust the position of point 42 or 46, and thereby the length of strap 14 that is between the adjuster and the respective first end 26 or second end 30 of the strap); and (ii) if the adjuster is in a second configuration, the adjuster will resist sliding relative to the strap (such that the length of strap 14 that is between the adjuster and the respective first end 26 or second end 30 of strap 14 is substantially constant). For example, and as described in more detail below with reference to FIGS. 9A-9K, adjusters 66 and 70 can comprise a mechanism that is similar in some respects to a type of mechanism often used in automotive lap belts to adjust the position of the buckle (and thereby the length of the lap belt).

In the embodiment shown, suspension members 38*a* and 38*b* are each non-removably coupled to the respective one of adjusters 66 or 70. For example, in the embodiment shown, suspension members 38*a* and 38*b* loop through an opening (e.g., opening 324 described below with reference to FIGS. 9B-9D) and are securely fastened back to themselves (e.g., via stitches, adhesive, rivets, and/or the like). In other embodiments, adjusters 38*a* and 38*b* are removably coupled to their respective adjusters (e.g., via hooks, buckles, connectors, or the like).

In some embodiments, first suspension member 38*a* is configured to be coupled to adjuster 66 and a supporting structure such that adjuster 66 is spaced apart from a supporting structure if first suspension member 66 is coupled to the supporting structure; and second suspension member 38*b* is configured to be coupled to adjuster 70 and a supporting structure such that adjuster 70 is spaced apart from a supporting structure if second suspension member 38*b* is coupled to the supporting structure. For example, in the embodiment shown, first suspension member 38*a* has a first end 74 configured to be coupled (and shown coupled) to first adjuster 66, and a second end 78 configured to be coupled to a supporting structure (e.g., as shown in FIGS. 3-8); and second suspension member 38*b* has a first end 82 configured to be coupled (and shown coupled) to the second adjuster, and the second end 86 configured to be coupled to a supporting structure (e.g., as shown in FIGS. 3-8).

In the embodiment shown, apparatus 10 also comprises: a first connector 94 coupled (and shown coupled) to second end 78 of the first suspension member and configured to couple the first suspension member to a supporting structure; and a second connector 98 coupled (and shown coupled) to second end of the second suspension member and configured to couple the second suspension member to a supporting structure. For example, in the embodiment shown, connectors 94 and 98 each comprises a carabiner. Additionally, in the embodiment shown, suspension members 38*a* and 38*b* each comprise an enlarged connection portion 102 (e.g., where each suspension member is doubled over and stitched to itself to hold the respective connector 94 or 98) having a thickness that is greater than the thickness of the rest of the respective suspension members 38*a* and 38*b*. As such, connection portions 102 can also serve as connectors, such as, for example, to close suspension members 38*a* and/or 38*b* in a door (between the door and the door jamb) such that one or both of connection portions 102 are on one side of the door and the remainder of apparatus 10 is on the other side of the door (e.g., so that the door acts an anchor for the apparatus during use). In other embodiments, these connectors can comprise any suitable structure (e.g., clips, tabs, buckles, and/or the like. In some embodiments, suspension members 38*a* and 38*b* each has a length equal to, or between any two of: 12 inches, 18 inches, 24 inches, 28 inches, 30 inches, 36 inches, or more. For example, in some embodiments, segments 54 and 58 of strap 14 each has a length of 8 feet; elastic segment 50 (and elastic portion 30) has a relaxed length of 30 inches; and/or suspension members 38*a* and 38*b* each has a length of 28 inches.

Referring now to FIGS. 3-8, shown there are examples of a use of the present apparatuses. In the embodiment shown, apparatus 10 is shown coupled to a supporting structure 200. In the embodiment shown, supporting structure 200 includes a pull-up bar 204 (e.g., of sufficient strength to permit a user 208 to perform standard body-weight pull-ups) such as, for example, that may be part of a gym rack or other exercise equipment, a playground gym, or the like. In the embodiment shown, suspension members 38*a* and 38*b* are configured to be coupled (and are shown coupled) to the supporting structure via connectors 94 and 98 (e.g., the carabiners 94 and 98 can be hooked around bar 204). In other embodiments, suspension members 38*a* and 38*b* can be wrapped around the bar and the carabiners 94 and 98 each hooked around the respective suspension members 38*a* or 38*b* (or any other structure, pole, and/or the like), carabiners 94 and 98 can be hooked to each other such that suspension members 38*a* and 38*b* cooperate to loop around the bar (or any other structure, pole, and/or the like), and/or suspension members 38*a* and 38*b* can be coupled to the supporting structure in any other way that permits the apparatus to function as described in this disclose (e.g., eyehooks can be secured to a supporting beam, such as, for example, the top of a suitably stable door frame). Some embodiments of the present apparatuses and systems include a supporting structure (e.g., 200) having a bar (e.g., 204) to which the one or more suspension members can be coupled.

In some embodiments, the one or more suspension members are coupled to in substantially-fixed relation to strap 14, with a part of the strap between first and second points at which the one or more suspension members is coupled to the strap forming a U-shape 212 onto which the feet of a user 208 can be positioned (and are shown positioned) such that elastic portion 34 can assist the user in performing pull-ups from the supporting structure. For example, in the embodiment shown, first and second suspension members 38*a* and 38*b* are coupled in fixed relation to the strap (e.g., such that the part of the respective suspension member does not move longitudinally relative to the strap) via adjusters 66 and 70 that are in the second configuration discussed above (in which adjusters 66 and 70 resist sliding relative to the strap).

Figure 3:
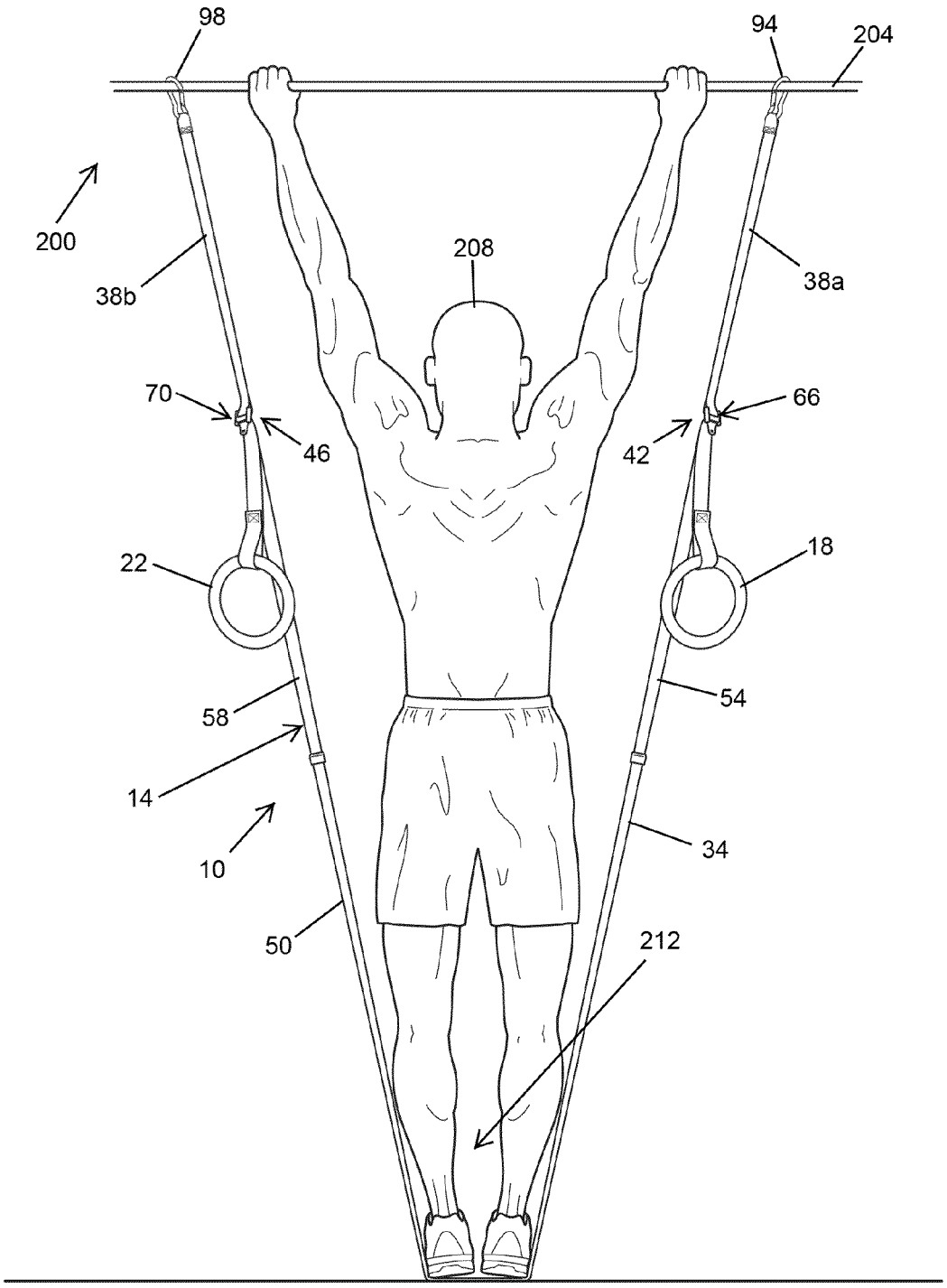
FIG. 3 depicts a user in a lower position of a pull-up assisted with the embodiment of FIGS. 1 and 2.
Figure 4:
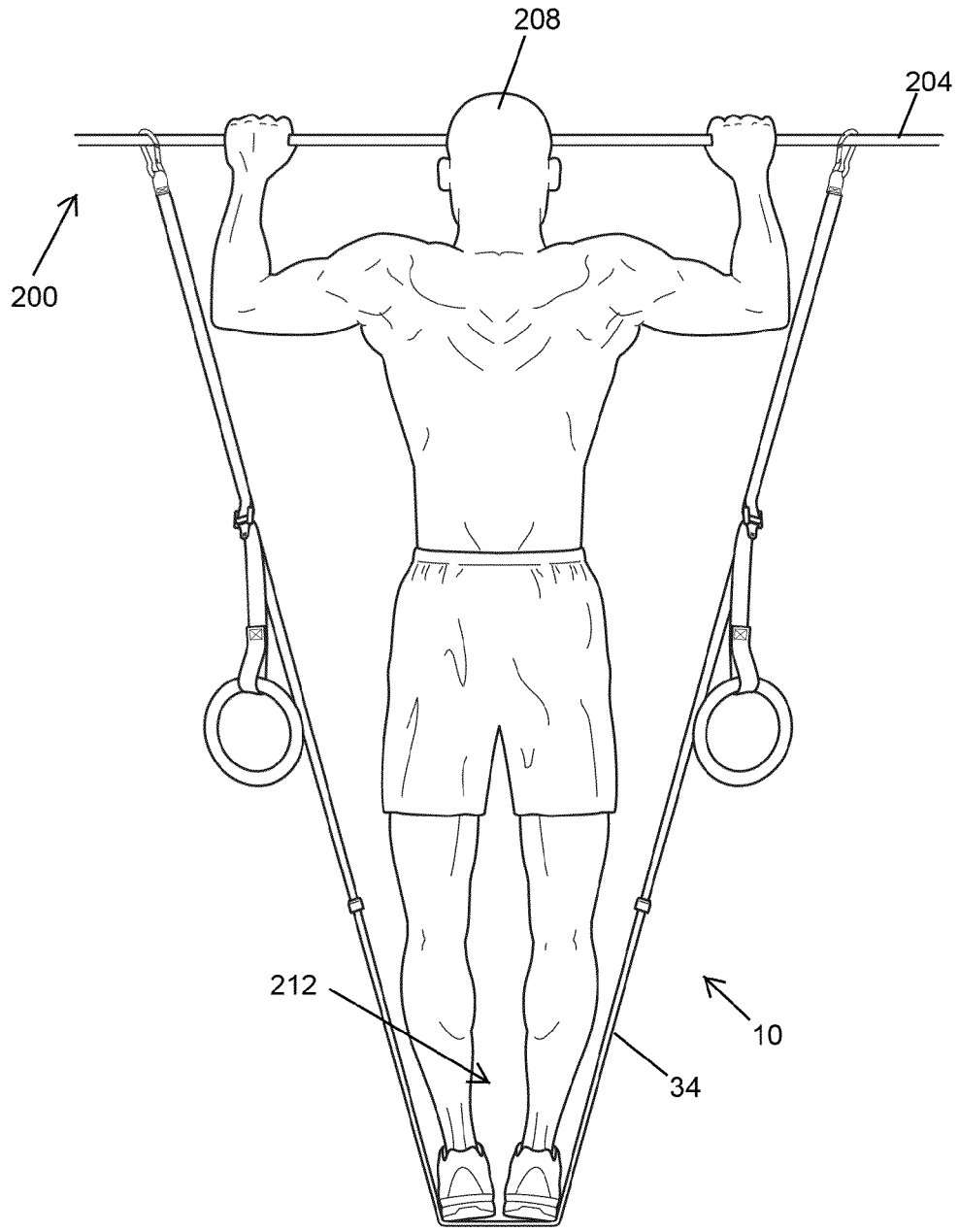
FIG. 4 depicts a user in an upper position of a pull-up assisted with the embodiment of FIGS. 1 and 2.

Examples of methods of using the apparatus can comprise any one or more of:

coupling (e.g., as shown) the one or more suspension members (e.g., 38*a* and 38*b*) to a supporting structure (e.g., 200) with a part of strap 14 between first and second points 42 and 46 at which the one or more suspension members are coupled to the strap forming a U-shape 212;

adjusting the position of the one or more suspension members (e.g., 38*a* and 38*b*) relative to at least one of first end 26 of the strap and second end 30 of the strap;

positioning at least one foot of a user 208 onto U-shape 212 (FIGS. 3-4);

performing pull-ups (FIG. 4) such that the elastic portion assists the user in performing the pull-ups;

positioning the trunk (e.g., chest) of a user 208 onto U-shape 212 (FIGS. 5-8);

performing push-ups such that the elastic portion assists the user in performing the push-ups (FIGS. 6 and 7); and/or adjusting (e.g., after positioning at least one foot of the user and/or after the use performs one or more pull-ups), the position of the one or more suspension members (e.g., 38*a* and 38*b*) relative to at least one of first end 26 of the strap and second end 30 of the strap to increase the length of strap between first and second points 42 and 46 at which the one or more suspension members are coupled to the strap.

The position of the one or more suspension members (e.g., 38*a* and 38*b*) relative to at least one of first end 26 of the strap and second end 30 of the strap can be adjusted with adjuster 66 and/or adjuster 70. For example, in the embodiment shown when tension is placed on strap below adjuster 66 (as indicated by arrow 216), adjuster 66 will resist sliding relative to the strap if adjuster is in the configuration shown (second configuration described above). However, if the tab or handle portion (320) of adjuster 66 is lifted relative to the strap, as described below, adjuster 66 will be permit a user to slide the adjuster (and thereby suspension member 38*a*) relative to strap 14, to adjust the position of suspension member 38*a* relative to first end of strap 26. Adjuster 70 can function in a similar manner to adjust the position of suspension member 38*b* relative to second end 30. If the length of strap 14 that is between points 42 and 46 is adjusted such that U-shape does not touch surface (e.g., ground) 220 (or touches surface 220 less than it would if a user positioned one his or her feet onto the U-shape), then when the user positions one or more feet onto the U-shape, as shown, elastic portion 34 will stretch when the user positions one or more feet onto the U-shape (and provide a force in upward direction 228 that can assist the user in performing push-ups). In this way, the shorter the length of strap 14 that is between points 42 and 46 (such that elastic portion 34 stretches by a greater amount, and thereby causes a relatively greater tension in the elastic portion, when the user steps onto U-shape 212 of the strap), the greater the assistive force; and the longer the length of strap 14 that is between points 42 and 46 (such that elastic portion 34 stretches by a relatively smaller amount, and thereby causes a relatively smaller tension in the elastic portion, when the user steps onto U-shape 212 of the strap), the less the assistive force.

As illustrated in FIG. 4, if one or more feet of a user (or knees, such as if the user is kneeling or lacks one or both lower legs) are positioned onto U-shape 212 of the strap, pull-ups can be performed such that elastic portion 34 assists the user in performing the pull-ups. As a user's strength and/or skill improves over time, the length of strap 14 between points 42 and 46 can be increased (e.g., points 42 and 46 can be moved closer to respective ends 26 and 30) such that the assistive force provided by elastic portion 34 decreases, and the user must provide greater force to complete the pull-up (e.g., eventually performing full-body-weight pull-ups without assistance). As such, embodiments of the present apparatus can enable a user without sufficient strength and/or skill to full-body-weight pull-ups to perform pull-ups with a full range of motion. After completion of the assisted pull-ups, the position of the suspension members relative to the strap can be adjusted (via adjusters 66 and 70) to increase the length of the strap between adjusters 66 and 70 and thereby reduce (e.g., and eliminate) tension in elastic portion 34 before the user's foot or feet are removed from the U-shape (212).

Figure 5:
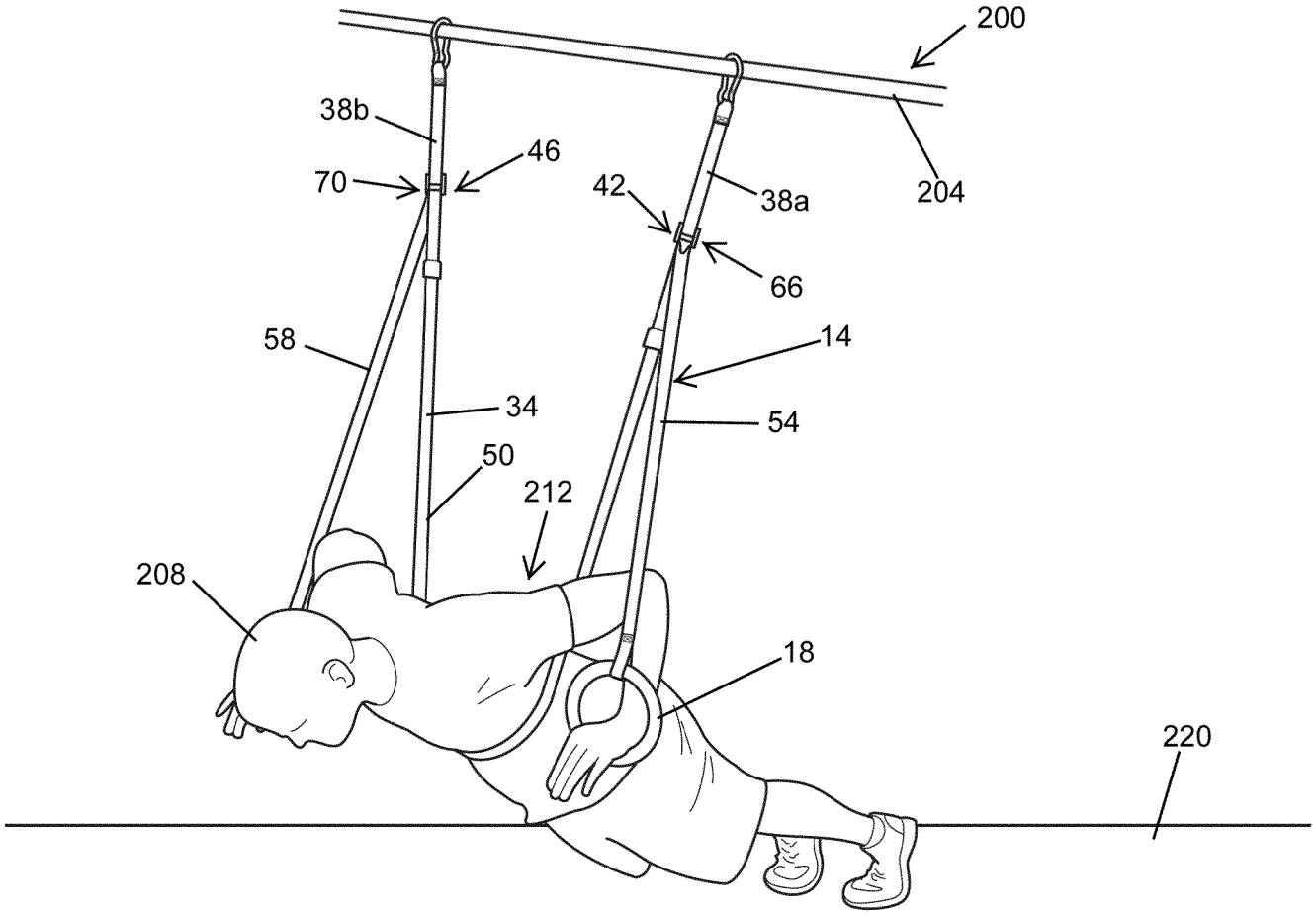
FIG. 5 depicts a user in a lower position of a first type of push-up assisted with the embodiment of FIGS. 1 and 2.
Figure 6:
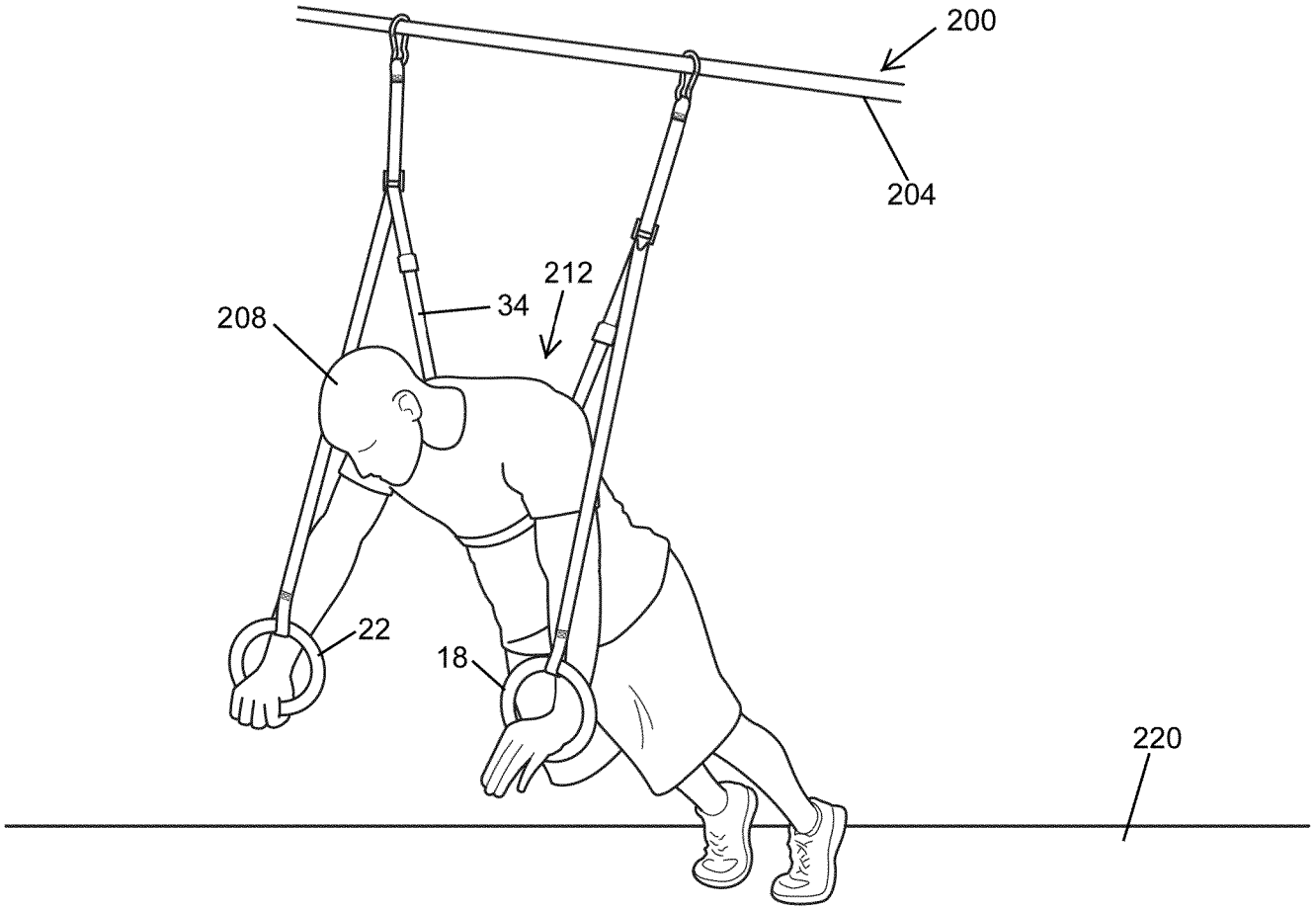
FIG. 6 depicts a user in an upper position of the first type push-up of FIG. 5.
Figure 7:
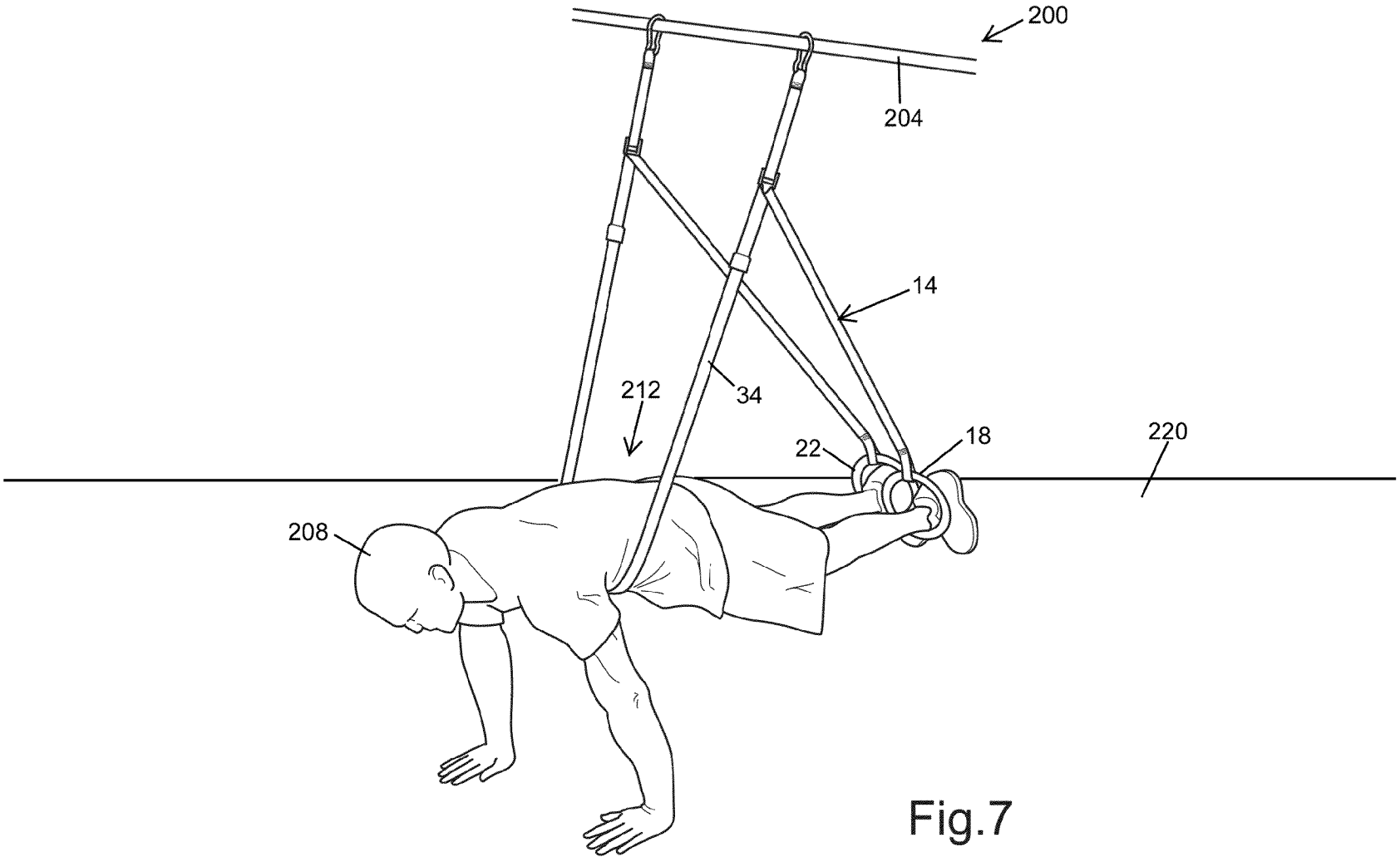
FIG. 7 depicts a user in an upper position of a second type of push-up assisted with the embodiment of FIGS. 1 and 2.
Figure 8:
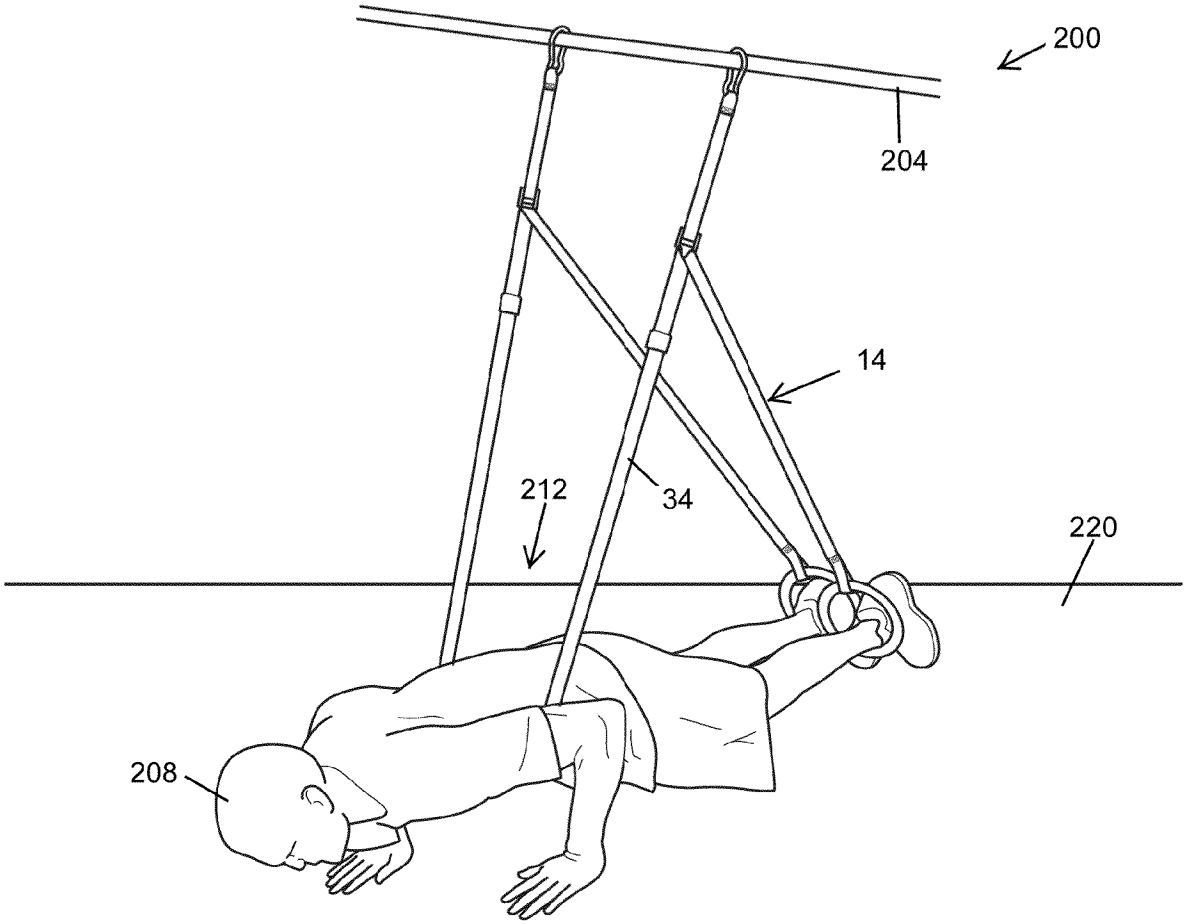
FIG. 8 depicts a user in a lower position of the second type push-up of FIG. 7.

As illustrated in FIGS. 6 and 7, if the trunk (e.g., chest) of a user is positioned onto U-shape 212 of the strap, push-ups can be performed such that elastic portion 34 assists the user in performing the push-ups. As a user's strength and/or skill improves over time, the length of strap 14 between points 42 and 46 can be increased (e.g., points 42 and 46 can be moved closer to respective ends 26 and 30) such that the assistive force provided by elastic portion 34 decreases, and the user must provide greater force to complete the push-up (e.g., eventually performing full-body-weight push-ups without assistance). As such, embodiments of the present apparatus can enable a user without sufficient strength and/or skill to full-body-weight push-ups to perform push-ups with a full range of motion. As shown in FIGS. 5 and 6, at least one hand (e.g., both hands) of the user can be supported by handle 18 and/or handle 22 while performing the push-ups (e.g., such that the user will engage a greater number of stabilizer muscles because handles 18 and 22 are unstable (e.g., can move laterally in any direction if not stabilized by the user)); and/or at least one foot (e.g., both feet) of the user can be supported by the ground. As shown, in FIGS. 7 and 8, at least one hand (e.g., both hands) of the user can be supported by the surface (e.g., ground) while performing the push-ups; and at least one foot (e.g., both feet) of the user can be supported by handle 18 and/or handle 22 while performing the push-ups (e.g., such that the user will engage a greater number of stabilizer muscles because handles 18 and 22 are unstable (e.g., can move laterally in any direction if not stabilized by the user)).

Apparatus 10 can be used in a variety of other ways and for a variety of other exercises as well. For example, with suspension members 38*a* and 38*b* coupled to bar 200, as shown, U-shape 212 can be extended horizontally such that a user 208 can stand in U-shape 212 of the strap and perform resisted running (such that elastic portion 34 resists motion of the user in the direction in which the user would travel if not held back by the strap). Elastic portion 34 can thus provide resistance for this and various other exercise (e.g., as opposed to providing assistance, as described above for the pull-ups and push-ups depicted in FIGS. 3-8).

Figure 9A:
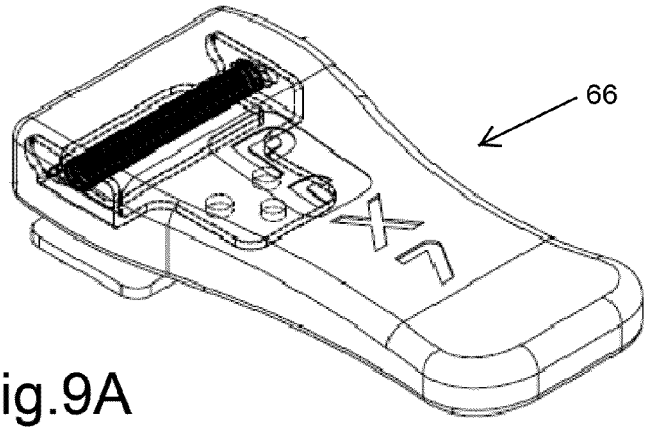
FIGS. 9A-9K depict various views of components of one embodiment of an adjuster assembly for use with some embodiments of the present apparatuses.
Figure 9B:
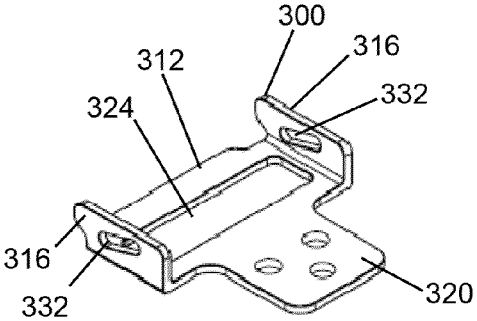
Figure 9C:
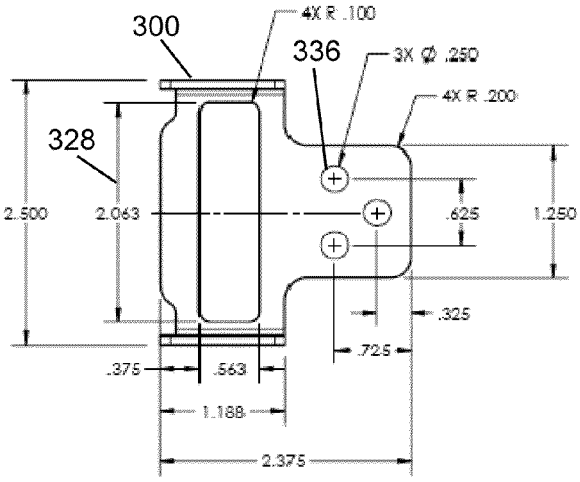
Figure 9D:
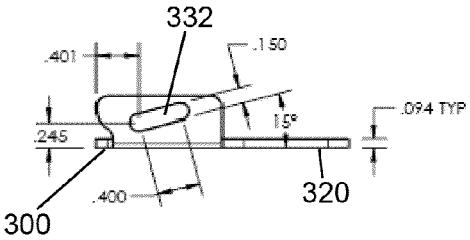
Figure 9E:
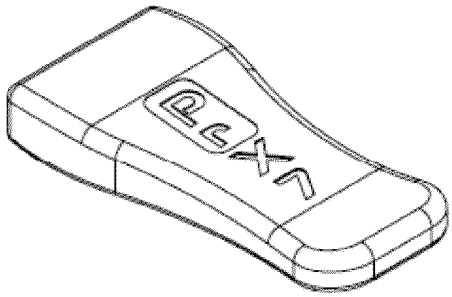
Figure 9F:
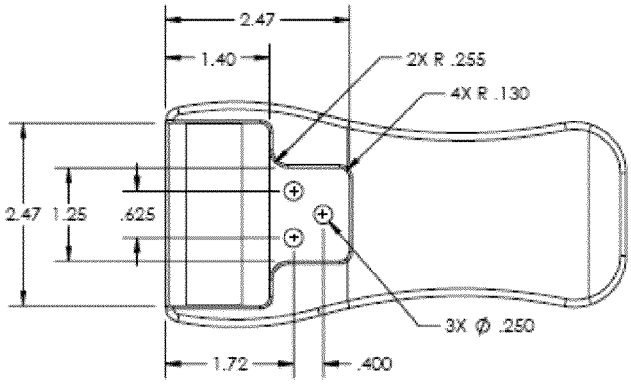
Figure 9G:
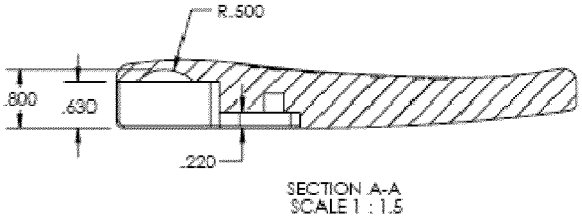
Figure 9H:
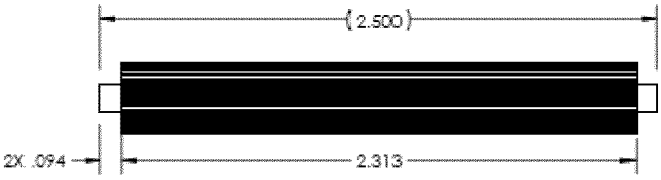
Figure 9I:
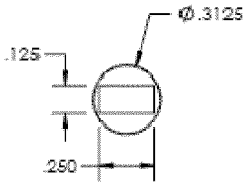
Figure 9J:
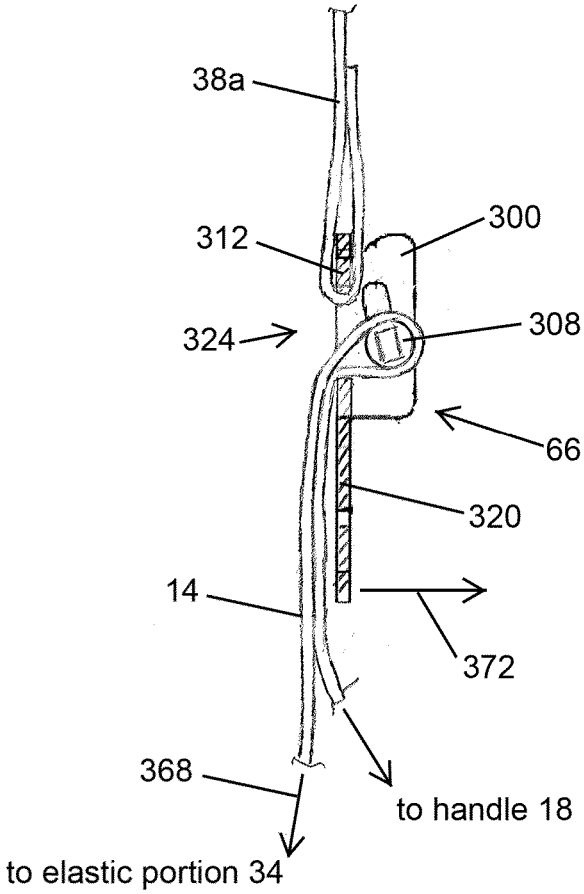
Figure 9K:
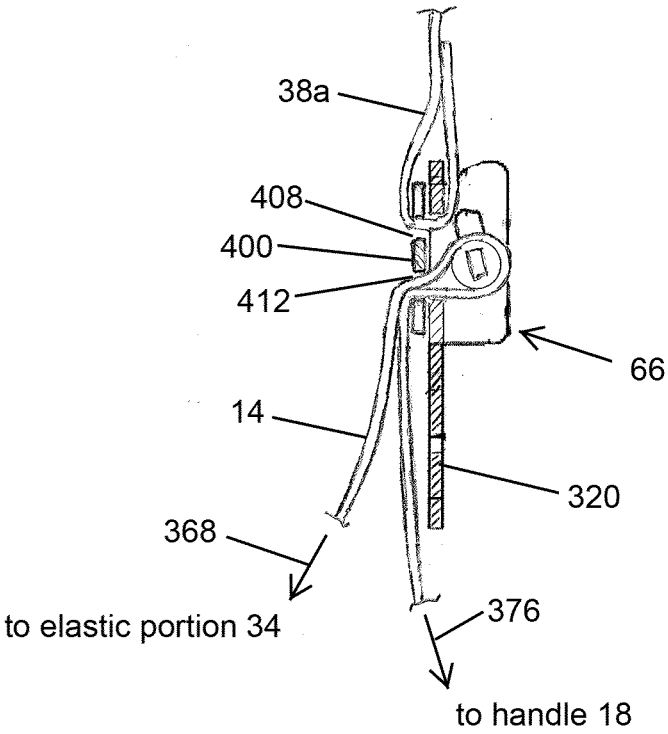

FIGS. 9A-9K depict various views of components of one embodiment of an assembled adjuster (e.g., 66 or 70) suitable for use with some embodiments of the present apparatuses. More specifically, FIG. 9A depicts a perspective view of the overall adjuster assembly 66, FIGS. 9B-9D depict various views of an adjuster frame or body 300, FIGS. 9E-9G depict various views of a handle extension member 304, FIGS. 9H-9I depict side and end views of a locking bar 308, FIG. 9J depicts a cutaway side view of adjuster frame 300 and locking bar 308 of adjuster 66 coupled to strap 14 and suspension member 38*a* to illustrate the function of adjuster 66; and FIG. 9K depicts a cutaway side view of a locking member 400 coupled to strap 14 and suspension member 38*a* in addition to adjuster 66 to illustrate the function of locking member 400. Although FIGS. 9A-9K are described with reference to adjuster 66, the structure and function of adjuster 70 are substantially identical in at least some embodiments. Additionally, dimensions (in inches) are shown for one non-limiting example of adjuster 66.

As shown in FIGS. 9B-9D, in the embodiment shown, adjuster frame or body 300 includes a substantially-planar portion 312, a pair of spaced-apart substantially-planar wing portions 316 that are not parallel (e.g., substantially perpendicular, as shown) to main portion 312, and a handle or tab portion 320 extending from main portion 312. In this embodiment, main portion 312 includes an elongated opening 324 disposed in a first plane (the plane of main portion 312) that has a width 328 at least as large as (e.g., larger than) the width of strap 14. In this embodiment, body or frame 300 also includes a pair of spaced-apart slots 332 disposed in a second plane (the respective planes of wing portions 316). As shown, each slot 332 is angled along its length relative to main portion 312, such that the distance between the slot and main portion 312 decreases as the distance from tab portion 320 increases. In this embodiment, handle portion 320 also includes a plurality of holes 336 for coupling body 300 to handle extension member 304, as described below.

As shown in FIGS. 9E-9G, handle extension portion 304 includes a cavity 340 for receiving body 300, and a plurality of holes 344 configured to align with holes 336 of body 300 (such that screws can be threaded through holes 336 and into handle extension member 304). In this embodiment, handle extension member 304 has an elongated shape configured to extend a distance 348 past tab portion 320 of body 300 (if member 304 is coupled to body 300) to provide a lever that decreases the amount of force needed to actuate the adjuster 66, as described below. In this embodiment, cavity 340 also includes an upper curved portion 352 that is configured to permit strap 14 to slide within the adjuster 66 when member 304 is coupled to body 300.

As shown in FIGS. 9H and 9I, in this embodiment, locking bar 308 includes a main cylindrical portion 356 (e.g., having a width at least as large as the width of strap 14) and rectangular end portions 360 that are sized and/or shaped to be slidably received in slots 332 and prevent bar 308 from rotating relative to body 300. Rod 308 is configured to extend between and into (i.e., such that rectangular end portions 360 extend into) each of slots 332 such that the rod is slidable relative to the body. The outer surface 364 of cylindrical portion can be knurled or otherwise textured to resist sliding of strap 14 relative to bar 308 when the adjuster is in a locked configuration, as described below.

FIG. 9J depicts locking bar 308 coupled to body 300 with strap 14 and suspension member 38*a* coupled to the adjuster. In the embodiment shown, a portion of suspension member 38*a* extends through opening 324 and around a front part of portion 312 of body 300 (opposite tab portion 320), and is doubled over and affixed to itself (e.g., with stitches, adhesive, rivets, and/or the like) to form a loop, as shown. In the embodiment shown, strap 14 extends through opening 324 twice and around rod 308. As described above, adjuster 66 is configured such that (i) if the adjuster is in a first (unlocked) configuration, the adjuster will slide relative to strap 14; and (ii) if the adjuster is in a second (locked) configuration, the adjuster will resist sliding relative to the strap. In FIG. 9J, the adjuster is shown in the second (locked) configuration. More specifically, bar 308 is disposed at the end of the slot that is closest to main portion 312 of body 300, such that if there is tension in direction 368 on the portion of strap 14 between adjuster 66 and elastic portion 34, bar 308 will remain in the depicted position to lock strap against body 14 and thereby resist sliding of the strap relative to the adjuster 66. To permit sliding of strap 14 relative to the adjuster (e.g., relative to bar 308 and body 300), handle portion 320 is moved in direction 372 away from strap 14 to cause bar 308 to slide away from handle portion 320 and permit strap to slide relative to bar 308 and body 300. The rate at which strap 14 is permitted to slide relative to adjuster can be adjusted by changing the distance between handle portion 320 and strap 14 (e.g., the further handle portion 320 is lifted in direction 372 relative to strap 14, the faster strap 14 will be permitted to slide relative to the adjuster).

Figure 10A:
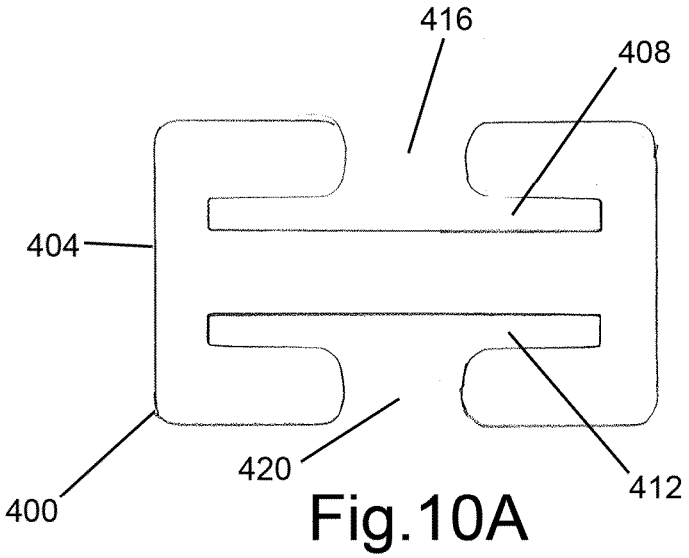
FIGS. 10A and 10B depict front and side views, respectively, of a locking member for use with some embodiments of the present apparatuses.
Figure 10B:
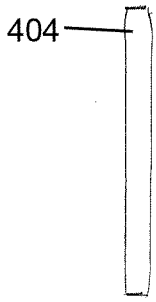

Referring now to FIGS. 9K and 10A-10B, an optional locking member 400 is shown for use with adjuster 66 to lock strap 14 relative to adjuster 66 even in the absence of tension in direction 368 on the portion of strap 14 between elastic portion 34 and adjuster 66 (e.g., if a user is using handle 18 without engaging elastic portion 34). In the embodiment shown, locking member 400 includes a substantially planar body 404 with two spaced-apart slots 408 and 412 each having a width equal to or larger (e.g., 5% larger) than the width of strap 14. Body 404 also includes opening 416 and 420 in each end to permit strap 14 to be inserted into the respective slot 408 or 412. As shown in FIG. 9K, locking member 400 can be coupled to strap 14 such that the loop that couples suspension member 38*a* to body 300 is also disposed in slot 408. In some embodiments, opening 416 is omitted such that suspension member 38 is non-removably disposed within slot 408. In use, once the position of adjuster 66 relative to strap 14 is set to a desired position, both sections of strap 14 (on either side of bar 308) can be pinched and/or otherwise inserted through opening 320 into slot 312 such that strap 14 extends twice through slot 412. In the configuration shown in FIG. 9K, locking member 400 helps to resist sliding of strap 14 relative to adjuster 66, even without tension in direction 368 on the portion of strap 14 between elastic portion 34 and adjuster 66 (e.g., with tension only in direction 376 on the portion of strap between adjuster 66 and handle 18). In other embodiments, any suitable locking member can be used to resist sliding of strap 14 relative to adjuster 66 in the absence of tension in direction 368 on the portion of strap 14 between elastic portion 34 and adjuster 66.

Figure 11:
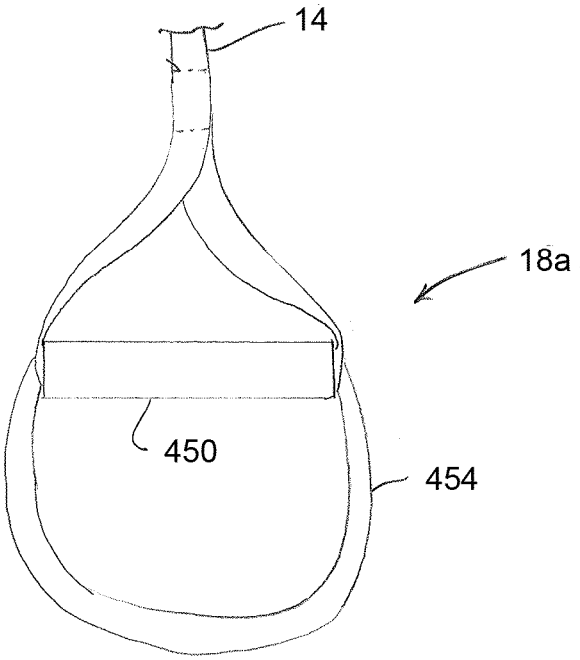
FIG. 11 depicts various views of a second embodiment of a handle suitable for use with some embodiments of the present apparatuses.

FIG. 11 depicts a front view of an alternate handle 18*a* that can be used with the present apparatuses. Although FIG. 11 is described with reference to handle 18*a*, the structure of both handles is substantially identical in at least some embodiments. In the embodiment shown, strap 14 extends through the longitudinal opening of a substantially-rigid piece of circular tubing 450 and the strap is affixed to itself (e.g., with stitches, adhesive, rivets, and/or the like) such that tubing 450 and strap 14 cooperate to define a loop, as shown. In some embodiments, strap 14 extends twice through tube 450 to form a second flexible loop 454. In other embodiments, loop 454 comprises a separate loop of material that also extends through tube 450.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present devices are not intended to be limited to the particular forms disclosed. Rather, they include all modifications and alternatives falling within the scope of the claims, and embodiments other than the one shown may include some or all of the features of the depicted embodiment. For example, components may be omitted or combined as a unitary structure, and/or connections may be substituted. For example, some embodiments may omit the handles, and/or may omit the one or more suspension members. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. An apparatus comprising:

a substantially-inelastic first strap segment;

a substantially-inelastic second strap segment;

an elastic third strap segment disposed between the first strap segment and the second strap segment;

one or more suspension members configured to be coupled (i) to the first strap segment spaced from the third strap segment by a first portion of the first strap segment, (ii) to the second strap segment spaced apart from the third strap segment by a second portion of the second strap segment, and (iii) to a supporting structure;

a first adjuster coupled to the first strap segment and configured to slide along the first strap segment to adjust the length of the first portion; and a second adjuster coupled to the second strap segment and configured to slide along the second strap segment to adjust the length of the second portion.

2. The apparatus of claim 1, where the third strap segment comprises at least one of: natural rubber, synthetic rubber, or a combination thereof.

3. The apparatus of claim 2, where the elastic segment comprises a plurality of strands of material.

4. The apparatus of claim 1, where the first substantially inelastic segment and second substantially inelastic segment are each configured to be removably coupled to the elastic segment.

5. The apparatus of claim 4, further comprising:

a first connector configured to couple the first substantially-inelastic segment to the elastic segment; and a second connector configured to couple the second substantially-inelastic segment to the elastic segment.

6. The apparatus of claim 1, where the first and second adjusters are each configured such that (i) if the adjuster is in a first configuration, the adjuster will slide relative to the strap; and (ii) if the adjuster is in a second configuration, the adjuster will resist sliding relative to the strap.

7. The apparatus of claim 6, where the first and second adjusters are configured to remain in the second configuration if there is tension in a portion of the strap between the adjuster and the elastic portion.

8. The apparatus of claim 7, further comprising:

a first locking member coupled to the one or more suspension members and coupled to the strap to resist sliding of the first adjuster relative to the strap in the absence of tension in the portion of the strap between the first adjuster and the elastic portion; and a second locking member coupled to the one or more suspension members and coupled to the strap to resist sliding of the second adjuster relative to the strap in the absence of tension in the portion of the strap between the second adjuster and the elastic portion.

9. The apparatus of claim 6, where the first and second adjusters each comprises:

a body having an opening disposed in a first plane, and a pair of spaced-apart slots each disposed in a second plane that is not parallel to the first plane; and a rod configured to extend between and into each of the spaced-apart slots such that the rod is slidable relative to the body;

where the strap extends through the opening twice and around the rod.

10. The apparatus of claim 1, where the one or more suspension members comprise:

a first suspension member having a first end and a second end, the first end configured to be coupled to the first strap segment, and the second end configured to be coupled to a supporting structure; and a second suspension member having a first end and a second end, the first end configured to be coupled to the second strap segment, and the second end configured to be coupled to a supporting structure.

11. The apparatus of claim 9, further comprising:

a first connector coupled to second end of the first suspension member and configured to couple the first suspension member to a supporting structure; and a second connector coupled to second end of the second suspension member and configured to couple the second suspension member to a supporting structure.

12. The apparatus of claim 1, further comprising:

a first handle configured to be coupled to the first strap segment such that the first handle is spaced from the third strap segment; and a second handle configured to be coupled to the second strap segment such that the second handle is spaced from the third strap segment.

13. The apparatus of claim 1, where the one or more suspension members are configured to be coupled to a supporting structure and in substantially-fixed relation to the strap, with the third strap segment and at least portions of the first and second strap segments together forming a U-shape onto which the feet of a user can be positioned such that the third strap segment can assist the user in performing pull-ups from the supporting structure.

14. The apparatus of claim 1, where the one or more suspension members are configured to be coupled to a supporting structure and in substantially-fixed relation to the strap, with the third strap segment and at least portions of the first and second strap segments together forming a U-shape onto which the trunk of a user can be positioned such that the elastic portion can assist the user in performing push-ups from the ground or from the handles.

15. The apparatus of claim 1, further comprising:

a supporting structure having a bar to which the one or more suspension members can be coupled.

16. A kit comprising:

an apparatus of claim 4, where the elastic segment is a first elastic segment; and an additional elastic segment.

17. The kit of claim 16, where the alternate elastic segment has a higher modulus of elasticity than the first elastic segment.

18. A method comprising:

coupling the one or more suspension members of the apparatus of claim 1 to a supporting structure with the third strap segment and at least portions of the first and second strap segments together forming a U-shape.

19. The method of claim 18 further comprising:

positioning at least one foot of a user onto the U-shape and performing pull-ups such that the elastic portion assists the user in performing the pull-ups.

20. The method of claim 18 further comprising:

positioning the trunk of a user onto the U-shape and performing push-ups such that the elastic portion assists the user in performing the push-ups.

21. The method of claim 18, further comprising:

adjusting at least one of: the length of the first portion and the length of the second portion.

* * * * *